US005714712A

United States Patent [19]

Ewick et al.

[11] Patent Number: 5,714,712

[45] Date of Patent: Feb. 3, 1998

[54] EXPLOSIVE INITIATION SYSTEM

[75] Inventors: David W. Ewick, North Granby; Daniel P. Sutula, Jr.; Brendan M. Welch, both of Farmington; Anthony Sendek, Canton, all of Conn.; Willie B. Eicke, Jr., Bay City, Tex.

[73] Assignee: The Ensign-Bickford Company, Simsbury, Conn.

[21] Appl. No.: 738,173

[22] Filed: Oct. 25, 1996

[51] Int. Cl.[6] ..... F42B 3/00; C06C 5/07

[52] U.S. Cl. ..... 102/311; 102/312; 102/313; 102/317; 102/318; 102/275.2; 102/275.4; 102/275.7; 102/275.8; 102/275.11

[58] Field of Search ..... 102/317, 318, 102/275.2, 275.4, 275.7, 275.8, 275.11, 312, 313, 311, 275.5, 275.6

[56] References Cited

U.S. PATENT DOCUMENTS

| | | | |
|---|---|---|---|
| 4,060,034 | 11/1977 | Bowman et al. | 102/24 R |
| 4,481,884 | 11/1984 | Yunan | 102/313 |
| 4,770,097 | 9/1988 | Wilson et al. | 102/312 |
| 4,953,464 | 9/1990 | Reiss | 102/312 |
| 5,216,197 | 6/1993 | Huber et al. | 102/317 |
| 5,359,935 | 11/1994 | Willett | 102/307 |
| 5,375,524 | 12/1994 | Larson | 102/217 |
| 5,388,521 | 2/1995 | Coursen | 102/311 |
| 5,398,611 | 3/1995 | Michna et al. | 102/275.7 |
| 5,614,693 | 3/1997 | Welch | 102/318 |

*Primary Examiner*—Peter A. Nelson

*Attorney, Agent, or Firm*—Law Office of Victor E. Libert; Victor E. Libert

[57] ABSTRACT

A detonation system especially useful for initiating a plurality of substantially simultaneous seismic detonations includes an electric trunkline circuit disposed on the surface of a firing site containing boreholes, within which booster charges having respective top and base portions are disposed. The booster charges are connected without intervening detonators to the downhole ends of equal-sized lengths of low-energy detonating cord, the surface ends of which are connected to semiconductor bridge-initiated electric detonators connected in series in the firing circuit. The resulting system, because of the small deviation in function time of the semiconductor bridge detonators, has greatly reduced scatter time as compared to prior art systems utilizing conventional downhole electric detonators, and has a safety advantage in that the boreholes are free of detonators. The booster charges are dimensioned and configured to direct more of their explosive energy in a downward direction than in an upward direction, and are fired at the top portion thereof, in order to maximize the downward direction of energy of the booster charge.

27 Claims, 4 Drawing Sheets

EXPLOSIVE INITIATION SYSTEM

BACKGROUND OF THE INVENTION

1. Field of the Invention

The present invention is generally concerned with an explosive initiation system of the type utilized in seismic exploration and analyses. In particular, the present invention relates to such an explosive system utilizing a combination of an electric trunkline circuit and a low energy detonating cord downline.

2. Related Art

In seismic exploration the shot pattern is laid out and one or a pattern of up to about ten holes (boreholes) are drilled vertically to depths from about 1.22 meters (4 feet) up to about 30.5 meters (100 feet) or more. The boreholes are then each loaded with a cast booster explosive typically ranging in size from about 0.113 to about 0.454 kilograms ("kg") (about ¼ to 1 pound) for shallow holes to about 0.454 to 4.990 kg (1–11 pounds) for deeper boreholes. Typically, the cast booster explosive has a cap well into which has been inserted an electric seismic blasting cap (detonator). The electric seismic detonator is usually fitted with electrically conductive legwires which are long enough to extend from the bottom of the borehole to the surface of the blasting site. It is also known in the art to utilize in lieu of the electrically-conductive legwires, downline high energy detonating cords to initiate the cast booster explosives. Such high energy detonating cords have explosive core loads of at least 5.3 grams per linear meter of cord (25 grains per linear foot of cord) of PETN or the equivalent explosive force provided by some other explosive. Such high-energy detonating cords are used to initiate the cast booster explosives without the intervention of a detonator between the downline detonating cord and the cast booster. For example, in the mining industry, the use of high energy detonating cord to directly initiate a cast booster is an accepted practice. Such high energy detonating cord typically has explosive core loads of, e.g., about 5.3 to 10.6 grams per meter (25–50 grains per foot) of PETN or the equivalent of another explosive. However, the high-energy detonating cords of the prior art release significant energy along paths remote from the points at which energy is released by the cast booster charges, and therefore render the seismic data less precise.

In any case, the cast booster charge is lowered to the bottom of the borehole by the legwires of the electric seismic detonator (or by the high energy detonating cord), and the borehole is then, depending on its depth and the nature of the ground, at least partly filled with stemming. An electric generator firing set is provided for connection to a surface firing cable trunkline to provide an electric circuit for energizing the seismic detonator. An array of geophones is accurately positioned on the surface relative to the shot (borehole) pattern. The wires of the electric seismic detonator are then connected to the firing cable and shot from an instrumentation truck. Usually, a plurality of boreholes, each with its own booster charge, are provided at the blast site, with the electric detonators connected in series in the trunkline firing circuit. Upon detonation of the booster explosive, a strong shock wave is emitted into the surrounding ground structure. At different strata or density changes in the ground structure, a reflection of a portion of the shock wave will occur. These reflections are detected by the geophones and the data is transmitted to the instrument truck. By knowing exactly when the shot(s) are fired, the velocity of sound in the rock and the distance between the geophones and the shot point, the depth and location of the strata and other geological formations may be determined. The accuracy of this determination is directly dependent on accurately knowing the time at which the booster charge(s) are shot, since all calculations are based on this input. When an array of holes is shot with a plurality of boreholes each containing a booster charge connected in series to the firing cable, ideally, each hole must shoot at the same time. Any difference in the time of shooting between boreholes appears as noise in the seismic record, complicates the interpretation of the records and reduces the accuracy of mapping the underground formations.

SUMMARY OF THE INVENTION

The present invention provides a system or assembly for initiation of booster charges, which system provides enhanced accuracy in causing the shooting of all of a plurality of booster charges at very close to the same time, thereby reducing "scatter" (the time interval(s) between shooting of the individual booster charges) and enhancing the accuracy of seismic mapping. The system of the present invention also increases the seismic shot energy attained per unit weight of a given booster charge, and enhances safety by making it possible to eliminate detonators from the boreholes. Generally, the present invention includes one or more of the following: 1) attaching a contact portion of a length of low energy detonating cord ("LEDC") directly to the booster charge without an intervening detonator; 2) configuring the booster charge to have a top portion of smaller diameter and lesser mass than a base portion, and connecting the LEDC to the top portion and seating the base portion on or facing the bottom of the borehole; and 3) initiating the lengths of LEDC by using semiconductor bridge ("SCB") electric detonators or any suitable electric detonators which are characterized a) by being capable of being initiated with as little as 5 millijoules of energy and b) by having a variation in time to initiation after energization ("scatter") of not more than about ±5 microseconds.

Specifically, in accordance with the present invention there is provided a detonation system for initiating one or more booster charges respectively disposed in one or more boreholes formed through the surface of a firing site and each having a respective bottom, the system comprising the following components. An electric trunkline circuit is disposed on the surface of the firing site and comprises one or more electric detonators, e.g., semiconductor bridge-initiated detonators, connected therein, the trunkline circuit being connectable to a fire set capable of generating an electric signal in the trunkline circuit to fire the one or more electric detonators. One or more booster charges are disposed within one or more boreholes with at least one booster charge per borehole. Each of the one or more booster charges is connected in signal-transfer relationship to an associated one of one or more lengths of low-energy detonating cord, which may all be of the same length, and which extend from their associated booster charges through their associated boreholes to the surface of the firing site to provide initiation portions of the lengths of low-energy detonating cord at the surface. The initiating portions are connected in signal transfer relationship to their associated electric detonators. With this arrangement, initiation of the one or more electric detonators by the electric trunkline circuit initiates the length of low-energy detonating cord connected thereto, which in turn initiates the booster charges connected to the associated lengths of low-energy detonating cord.

In one aspect of the invention, the system comprises a plurality of the booster charges disposed in respective ones of a plurality of the one or more boreholes.

In another aspect of the invention, the trunkline circuit further comprises one or more connector blocks having an associated one of the electric detonators disposed therein and further having thereon retention means for securing the initiation portion of the associated lengths of low-energy detonating cord in signal transfer proximity to their associated electric detonators.

Another aspect of the invention provides for the lengths of low-energy detonating cord to be connected to their associated booster charges without a detonator interposed between the low-energy detonating cord and the booster charge, whereby the booster charge is directly initiated by the length of low-energy detonating cord. For example, the lengths of low-energy detonating cord have contact portions thereof which may be retained within wells formed in the booster charge or which may be embedded within the booster charges.

Yet another aspect of the present invention provides for the booster charges to have top sections which are disposed facing the surface of the blasting site and base sections which are disposed facing their respective borehole bottoms, and are dimensioned and configured to direct more of their explosive energy in a downward than in an upward direction. The initiating portions of the lengths of low-energy detonating cord are connected to the top sections of the booster charges.

In a related aspect of the invention, the top sections may be of smaller diameter and, optionally, of lesser mass than the base sections.

A method aspect of the invention provides a method of initiating one or more booster charges disposed in respective one or more boreholes and connected to the surface of a blasting site in which the boreholes are formed by one or more lengths of low-energy detonating cord which have contact portions disposed in signal transfer contact with their booster charges, and which terminate in one or more surface sections of the low-energy detonating cord. The method comprises the following steps. The surface sections are connected in signal transfer proximity to one or more electric detonators forming part of an electric trunkline circuit. The trunkline circuit is connected to a fireset capable of energizing the trunkline circuit to initiate the one or more electric detonators, and the firing set is then discharged. These steps result in initiating the one or more electric detonators which in turn initiate the one or more lengths of low-energy detonating cord, which in turn initiate their associated booster charges.

The method of the invention may use the system described above in order to carry out the method.

The method of the invention provides, in one aspect, substantially simultaneously initiating a plurality of up to about ten booster charges with a time scatter standard deviation of not more than about 0.017 milliseconds.

As used herein and in the claims, the term "detonating cord" has its usual meaning of a flexible, coilable cord having a high explosive core, usually of pentaerythritol tetranitrate ("PETN"), and a "low energy detonating cord", sometimes abbreviated "LEDC", means a detonating cord containing sufficient explosive to directly initiate a booster charge, but less than 5.3 grams per linear meter of cord (25 grains per linear foot) of PETN, or the equivalent in explosive force of some other explosive. For example, a preferred LEDC, especially for use with Pentolite (PETN and TNT) booster charges, contains not more than about 1.7 grams of PETN per meter of cord length (8 grains per foot of cord length), e.g., from about 1.28 to 1.7 grams of PETN per meter of cord length (6 to 8 grains per foot of cord length), or the equivalent in explosive force of other suitable explosives.

As used herein and in the claims, the term "booster charge" may mean a single booster charge or two or more booster charges joined or positioned together to form a booster charge unit. A plurality of "booster charges" means a plurality of such booster charge units.

DETAILED DESCRIPTION OF THE INVENTION AND SPECIFIC EMBODIMENTS THEREOF

Figure 1:
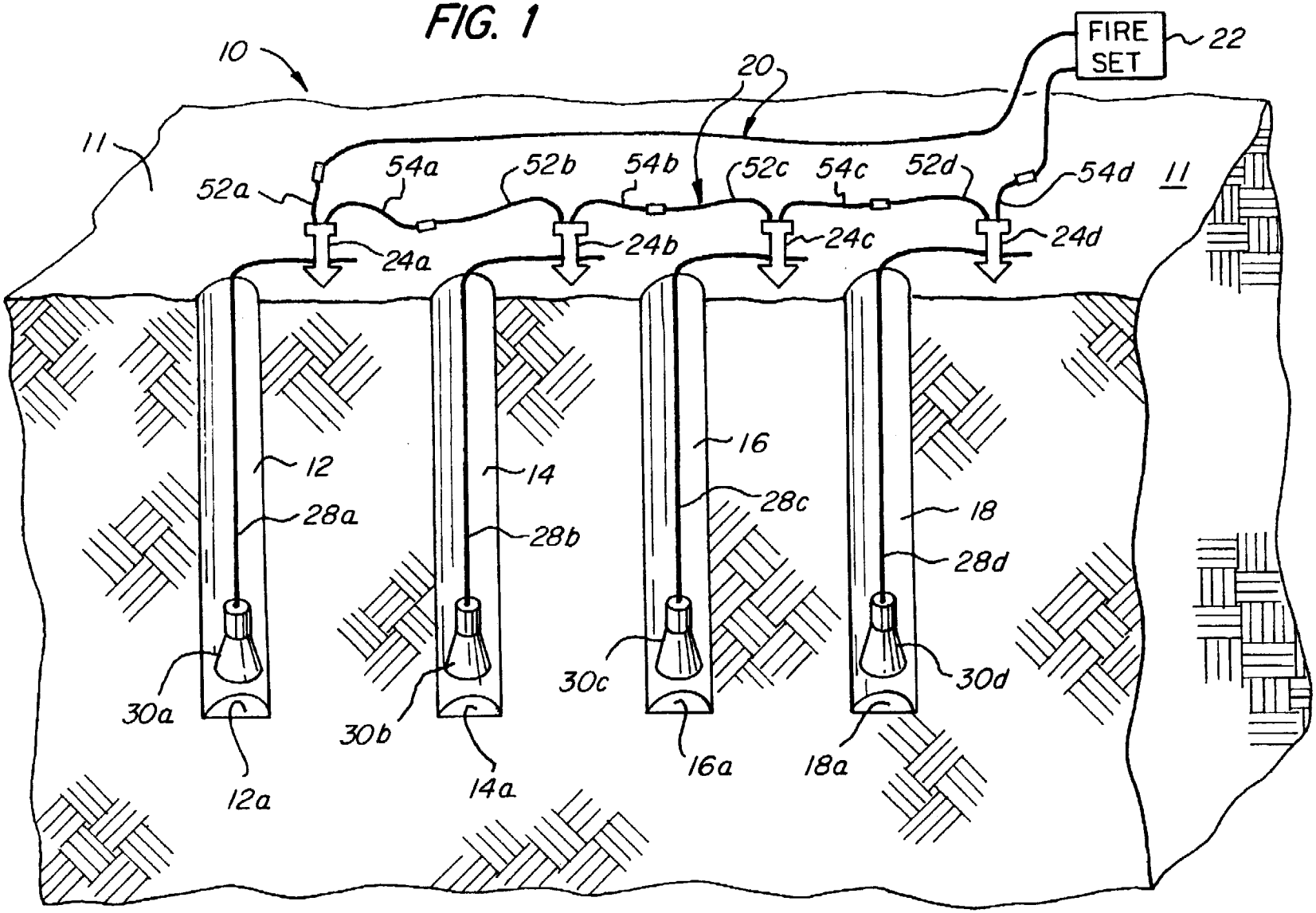
FIG. 1 is a schematic perspective view of a multi-hole seismic blasting site in which a detonation system in accordance with one embodiment of the present invention has been installed.

In seismic operations relatively small explosive charges are detonated, usually underground, in order to record the resulting shock wave, its speed of travel underground, its reflection off objects and underground formations, etc., in order to carry out seismic surveying and acquire data concerning underground formations. Such applications require explosive initiation systems with excellent timing precision and accuracy, in order to obtain accurate surveying data. To the extent that there is variation in the timing of a series of seismic explosions, often referred to as "scatter", the accuracy of the data recorded from the shock waves is reduced and the less accurate will be the resulting seismic data or mapping.

From a seismic point of view, it is important that the booster energy be directed down the borehole with minimal upward projection. Because the shock wave is reflected at every interface it encounters, when the booster charge detonates, shock waves will be reflected upwardly from some rock or other interface located at a lower depth, as will those twice-reflected waves emanating from the surface which strike the interface and are reflected back to the surface. The two sets of shock waves may arrive at the seismic sensors at different times because of the different distances traveled. The surface-reflected waves arriving at the seismic sensors after being reflected twice will be out of phase with those which experience only one reflection. The twice-reflected waves therefore arrive at the sensors later and out of phase from the single-reflected wave which was projected directly downward from the booster. The twice-reflected wave is superimposed on the direct singly-reflected wave in the form of noise, and clutters the seismic record. This phenomena is known as ghosting.

For the foregoing reasons it is important to direct the explosive energy in one direction as much as possible, and ideally, all the energy would be directed from the booster charge downwardly. It is also true that the stronger the shock wave, the better the seismic record obtained. Conversely, if the booster can be made smaller and yet generate a shock wave of similar magnitude as that obtained from a larger booster, the cost of seismic evaluations is reduced because the smaller booster charge costs less. The smaller weight and size of a booster charge which is capable of yielding a shock wave of magnitude comparable to that of a larger booster charge is particularly important when one considers that seismic exploration frequently occurs in remote locations, which often requires the booster charges and other materials to be carried to the location by backpack. Weight and bulk is then obviously a significant consideration. A 226.8 gram (8 ounce) booster charge in accordance with the present invention would be as seismically effective as a 340.2 to 453.6 gram (12 to 16 ounce) standard cylindrical booster, representing a substantial weight and bulk savings. Of course, a coil of LEDC has greater weight and bulk than a coil of a corresponding length of electrical legwires, so that some of the bulk and weight advantage provided by the smaller booster charges of the present invention, as compared to those of prior art systems, is off-set.

Figure 2:
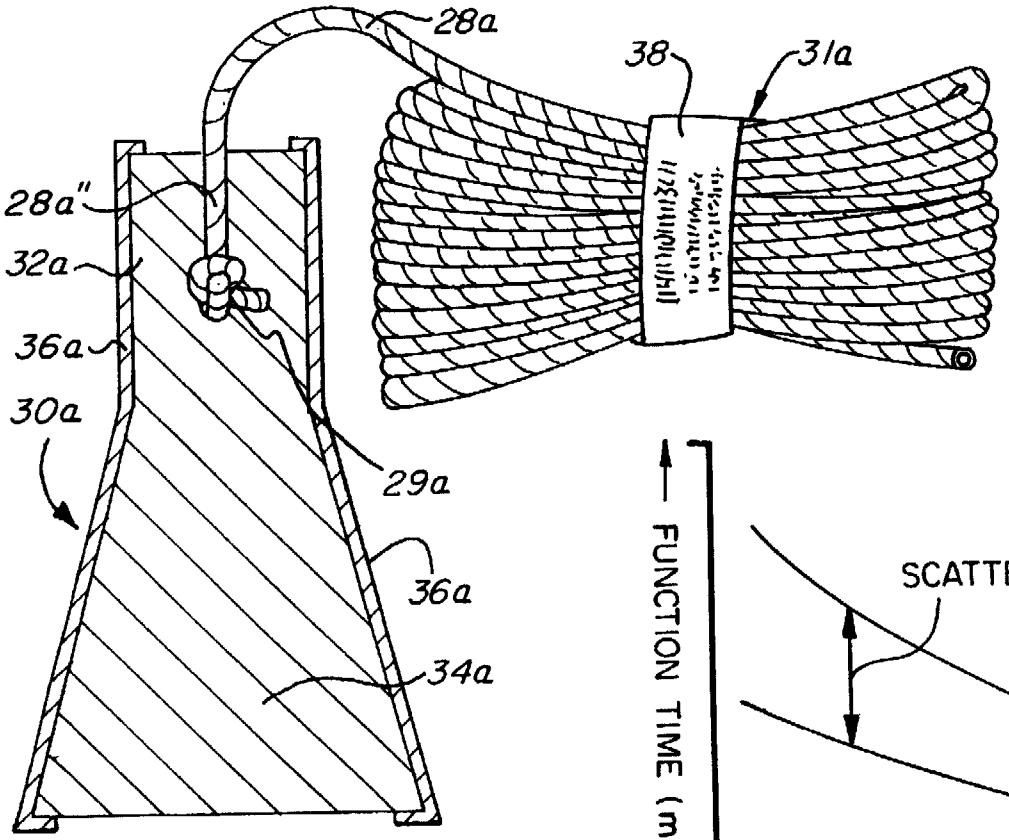
FIG. 2 is a cross-sectional view of a booster charge and its associated length of low-energy detonating cord in accordance with one embodiment of the present invention.

Booster charges may be dimensioned and configured in a number of ways, so that more of their explosive energy is directed in a downward rather than in an upward direction. One such configuration of a booster charge is shown in FIG. 2, but other shapes will exhibit the same characteristic. For example, the bottom section may be shaped like a truncated cone, with the base being the larger diameter base of the truncated cone. Alternatively, the top section may be cylindrical of a given diameter and the base section may also be cylindrical in shape, of a larger diameter than the top section. In another embodiment, the bottom or base of the truncated cone forming the base section of the booster charge may be of concave configuration to provide a downwardly-directed Munro effect. It is not always essential that the base portion have a greater mass than the top portion, as the majority of the explosive force of the booster charge can be directed in a downward direction even if the mass of the base section of the booster charge is equal to or less than the mass of the top section, provided that the base section is dimensioned to be of larger diameter than the top section, and/or is otherwise configured to direct more than half of the explosive energy released by initiation of the booster charge in a downward direction.

It has also been found that enhancement of the downward direction of explosive force of the booster charge is attained when the booster charge is initiated as close to the top thereof as is feasible. Generally, this will involve connecting the LEDC or other initiator (such as a detonator) as close to the top of the booster charge as is consistent with engaging enough of the LEDC or detonator with the booster charge to ensure reliable initiation. For example, with reference to FIG. 2, the contact section 28a" of the length of low-energy detonating cord 28 is embedded within top section 32a of booster charge 30a, for a distance sufficient to ensure reliable initiation. For purposes of maximizing the downward direction of explosive force of booster charge 30a, it is desirable that the initiation take place as close as is feasible to the topmost portion (as viewed in FIG. 2) of top section 32a.

A booster charge having a top end of lesser mass than its base end, e.g., a substantially conical-shaped booster charge, which is initiated at its smaller, top end will detonate towards the large end and project a strong impulse in the direction of detonation, with very little misdirected energy.

Referring now to FIG. 1, there is schematically illustrated a cross-sectional view of a seismic blasting site 10 comprised of four boreholes, 12, 14, 16 and 18. The boreholes 12–18 may be of any depth appropriate to the seismic task at hand, which, in the case of multiple boreholes as illustrated, is about 3 meters (about 10 feet) or more. Each of the boreholes 12–18 terminates in a respective borehole bottom 12a, 14a, 16a and 18a. As is normally the case in seismic blasting sites, each of the boreholes 12–18 is of equal depth.

A detonation system in accordance with one embodiment of the present invention comprises an electric trunkline 20 which, in the schematic illustrated embodiment, is shown connected to a fireset 22, which comprises an electric generator of the known type utilized for initiating electric detonator systems. A plurality of connector blocks 24a, 24b, 24c and 24d each contains therein a semiconductor bridge detonator (not visible in FIG. 1), a typical one of which is shown as detonator 26a in typical connector block 24a illustrated in FIGS. 3A and 3B. Semiconductor bridge detonators are preferably characterized by being capable of being initiated by as little as 5 millijoules of energy, and by having a variation in time to initiation after energization ("scatter") of not more than about ±5 microseconds. Identical semiconductor bridge electric detonators (not shown) are contained, one each, in connector blocks 24b, 24c and 24d. As described in more detail below, in connection with FIGS. 3A and 3B, the SCB electric detonators within each of connector blocks 24a–24d are retained in signal transfer proximity with an initiation section 28a' of a length of low-energy detonating cord 28a. A suitable low-energy detonating cord has a loading of from 1.28 to 1.7 grams of PETN per meter of cord length (about 6 to 8 grains per foot). The length of low-energy detonating cord 28a extends from the surface 11 of blasting site 10 down through borehole 12 to at or near the bottom 12a thereof, wherein the length of low-energy detonating cord 28a is connected to a booster charge 30a. The booster charge may be any standard design as used in the seismic industry that is of sufficient sensitivity to be directly initiated from LEDC (the seismic booster is in the prior art typically initiated by a seismic electric cap). However, a booster charge of the type illustrated in FIG. 2 is preferred for the reason set forth elsewhere herein, i.e., to maximize the downward vector of seismic energy derived from the charge.

As best seen in FIG. 2, booster charge 30a comprises a top portion 32a which is of smaller diameter and lesser mass than a base portion 34a. In the cross-sectional profile of FIG. 2, the base portion 34a is seen to be of truncated conical configuration and the top portion 32a is seen to be of circular cylindrical configuration. A contact section 28a" of the low-energy detonating cord 28a is embedded within booster charge 30a and terminates in an embedded knot 29a, which helps to retain contact section 28a" in place. The booster charge 30a may comprise any suitable explosive, usually a mixture of PETN and trinitrotoluene ("TNT"). In order to enhance the reliability of initiation of booster charge 30a, a more sensitive secondary explosive such as PETN (unmixed with TNT) may be provided to enclose the embedded contact section 28a" of the length of low-energy detonating cord. Thus, the area of top portion 32a of booster charge 30a surrounding the embedded or emplaced contact section 28a" may be fitted with a sleeve of PETN.

Booster charge 30a is encased within a shell 36a, which may be made of any suitable material such as a plastic material such as medium or high density polyethylene. In the embodiment of FIG. 2, the free length of low-energy detonating cord 28a is formed into a coil 31a, which is retained by a suitable wrapper 38.

The booster charge with its associated length of low-energy detonating cord may be factory-manufactured so that it is ready for use when received at the site, or assembly of the contact portion 28a" into the booster may be left to be done at the blasting site or elsewhere in the field.

Boosters 30b, 30c and 30d are identically configured to booster 30a; their associated lengths of low-energy detonating cord 28b, 28c and 28d are identically connected to their associated boosters and associated connector blocks 24b, 24c and 24d. Accordingly, there is no need to repeat the description for boreholes 14 through 18.

Figure 2A:
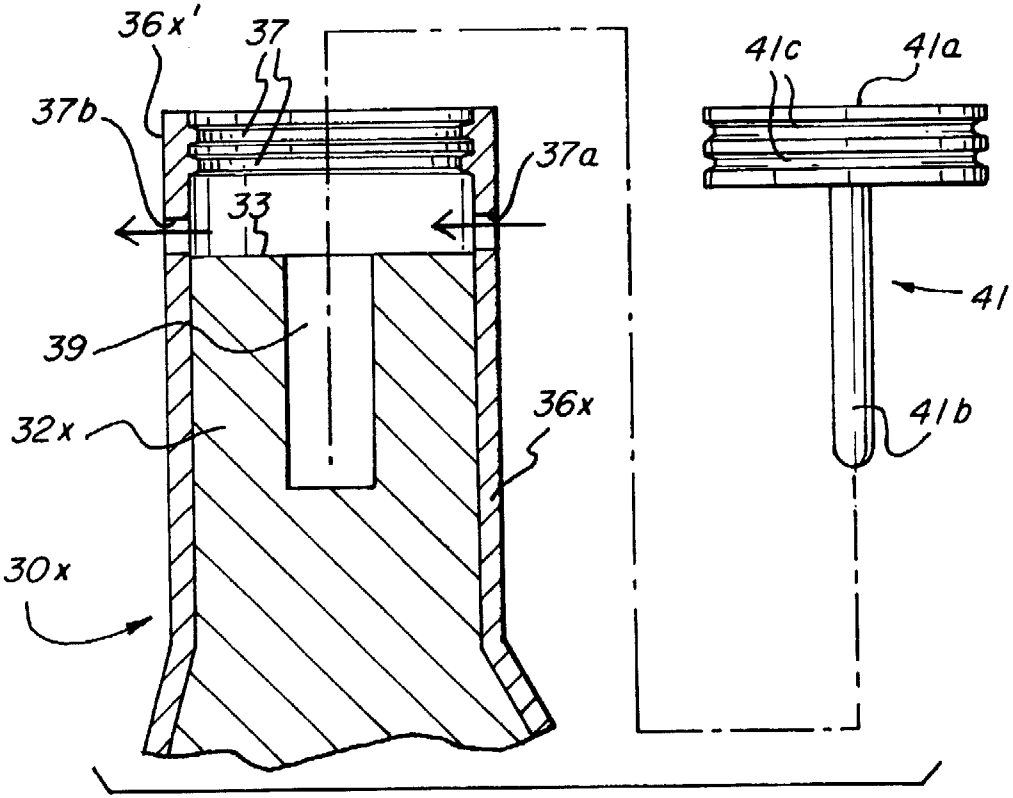
FIG. 2A is a partial cross-sectional exploded view of a booster charge in accordance with another embodiment of the present invention showing the top section of the booster charge and a cord-retaining fixture adapted to be secured to the booster charge.
Figure 2B:
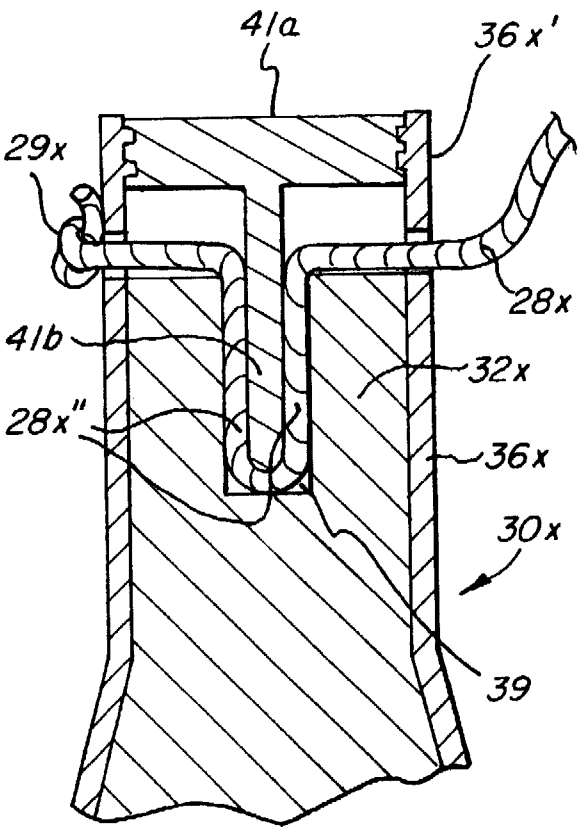
FIG. 2B is a partial cross-sectional view of the top section of the booster charge of FIG. 2A with its cord-retaining fixture in place and retaining its associated length of low-energy detonating cord in contact with the booster charge.

Other methods of attaching the contact portion 28a" of the length of low-energy detonating cord 28a to the booster charge 30a may of course be utilized. For example, one or a pair of wells may be employed through which contact section 28a" may be threaded and knotted or otherwise retained in place. Referring to FIGS. 2A and 2B there is shown an alternate construction of the top section 32x of a booster charge 30x having a shell 36x which has a cup portion 36x' thereof which extends above the top surface 33 of the top section 32x of booster charge 30x. A pair of shoulders 37 is formed on the interior of portion 36x'. A pair of diametrically opposed holes 37a, 37b are formed in cup portion 36x' just above the top surface 33 and a cord well 39 is formed in top portion 32x and extends downwardly from surface 33 thereof. A cord-retaining member 41 comprises a disc-shaped closure cap 41 a having grooves 41c formed therein, and a bayonet-shaped plunger arm 41b. Cord well 39 is large enough to accommodate in a snug fit a doubled length of low-energy detonating cord 28x plus plunger arm 41b. Grooves 41c are complementary to shoulders 37 to receive the latter in grooves 41c as described below. In use in the field, or at the factory, the end of a length of low-energy detonating cord 28x containing contact section 28x" is passed through holes 37a, 37b as indicated by the unnumbered arrows in FIG. 2A, and a knot 29x, as illustrated in FIG. 2B, is formed in the end of low-energy detonating cord 28x which projects beyond hole 37b. Cord-retaining member 41 is then inserted into the opening provided by the extension 36x' of shell 36x and pushes the contact portion 28x" of the length of low-energy detonating cord 28x into cord well 39, pressing contact portion 28x" firmly into contact with the walls of cord well 39. The grooves 41c formed about the periphery of closure member 41 a engage in a snap-fit with the ribs 37 extending about the inner periphery of extension 36x'. In this way, cord-retaining member 41 is firmly affixed to the top section 32x of the booster charge and retains the contact portion 28x of the length of low-energy detonating cord 28x in firm, signal transfer contact with the booster charge top section 32x. For field assembly models, if desired, cord-retaining member 41 may be connected to shell 36x, as by a lanyard, in order to prevent separation of cord-retaining member 41 from the rest of the booster charge.

Figure 3A:
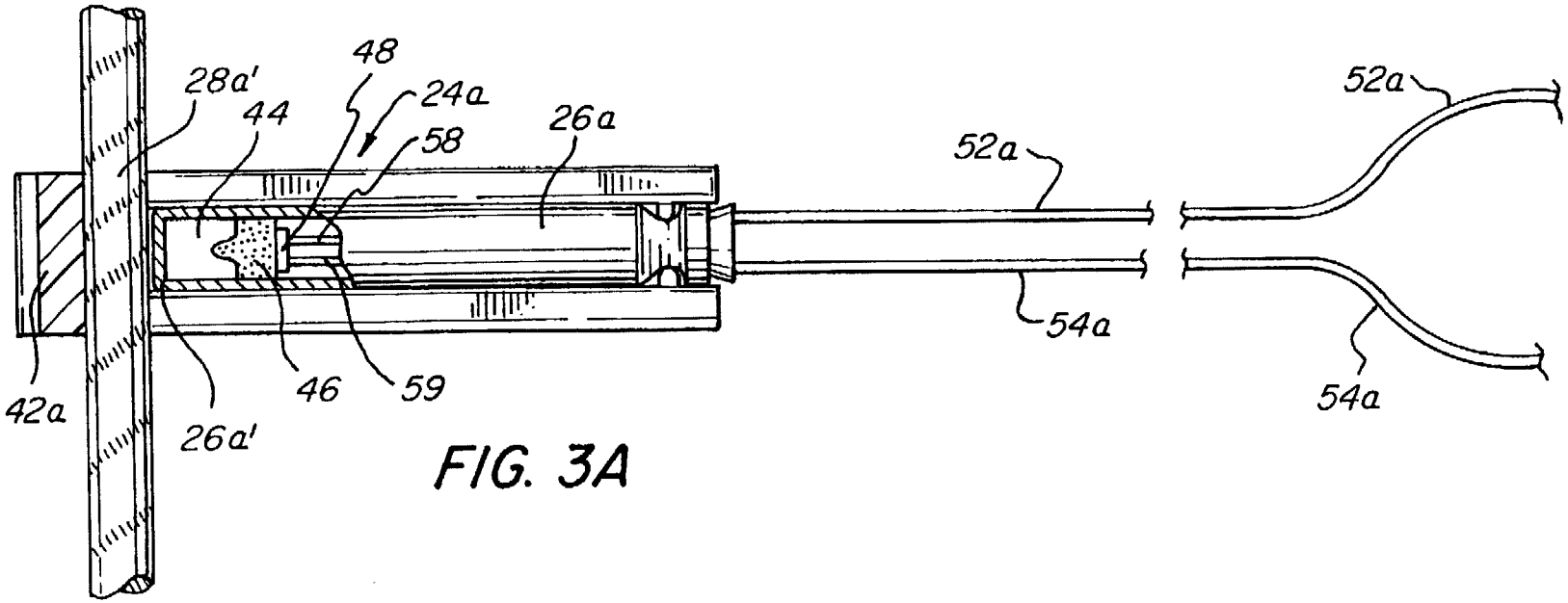
FIG. 3A is a cross-sectional view of an assembly of a connector block, semiconductor bridge detonator and an initiation segment of low-energy detonating cord as used in the system of FIG. 1.
Figure 3B:
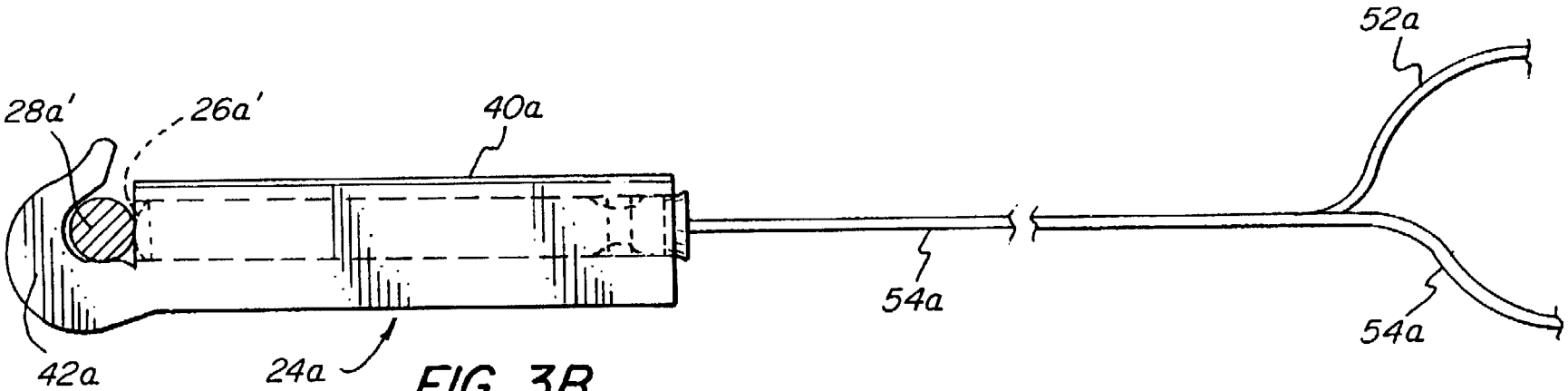
FIG. 3B is an elevation side view of the assembly of FIG. 3A.

Referring now to FIGS. 3A and 3B, connector block 24a is seen to comprise a generally elongate body portion 40a having formed therein a longitudinal tunnel or opening (unnumbered) within which semiconductor bridge electric detonator 26a is received, with the active (explosive-containing) end 26a' of detonator 26a being disposed adjacent a retention means 42a of generally curved configuration, within which the initiation section 28a' of the length of low-energy detonating cord 28 may be secured. In the partially broken-away view of FIG. 3A, the conventional secondary explosive charge 44 (e.g., PETN or the like) and primary explosive charge 46 (e.g., lead azide, lead styphnate, or the like) are encased within the conventional metal, e.g., aluminum, shell (unnumbered) of detonator 26a. A semiconductor bridge igniter 48 is connected by electrically conducting wires 58, 59 to provide electric current through appropriate circuitry (not shown) contained within detonator 26a via legwires 52a, 54a of detonator 26a. Legwires 52a, 54a emerge from connector block 24a for connection as part of the electric trunkline circuit 20 as shown in FIG. 1. Also seen in FIG. 1 are the corresponding legwires 52b/54b, 52c/54c and 52d/54d of the detonators (not shown) contained within, respectively, connector blocks 24b, 24c and 24d.

In order to set up the blasting site 10, boreholes 12, 14, 16 and 18 will be drilled by an auger or other suitable equipment, and a plurality of booster charges such as booster charge 30a of FIG. 2 will be brought to the site, the band 38 is broken, and the booster charge lowered to the bottom of its associated borehole by means of the length of low-energy detonating cord 28a. Low-energy detonating cord has a higher tensile strength than the electrically-conducting legwires of an electric detonator, and so there is less danger of breakage or abrasion in lowering the booster charge to the bottom of the borehole by means of the low energy detonating cord than would be the case using the prior art construction of providing booster charge 30a with an electric detonator cap embedded therein and using long legwires (up to 100 feet or longer) to lower the booster charge to the bottom of the borehole. The insulation on the copper wires may readily be abraded as the booster charge is lowered into the borehole, and because of the lesser tensile strength of the legwires as compared to the low-energy detonating cord, there is greater danger with the prior art construction of breaking the downhole connection during lowering of the booster charge.

Once the booster charge 30a has been lowered to the bottom of borehole 12 to rest upon bottom 12a thereof, borehole 12 may be filled or topped with stemming (not shown) depending on the depth of the borehole and ground conditions, while being sure to maintain a length of low-energy detonating cord 28a, including its initiation section 28a', on the surface 11. The process is repeated in identical fashion for the remaining boreholes, boreholes 14–18 in the illustrated embodiment. When it is ready to detonate the booster charges 30a–30d, fireset 22 is provided and electric circuit trunkline 20 is laid out. This step includes fastening connector blocks, such as connector block 24a, containing therein an electrical semiconductor bridge detonator such as 26a, to each of the protruding lengths of low-energy detonating cord 28a–28d at the initiating segment thereof, illustrated by typical initiating segment 28a' of the length of low-energy detonating cord 28a.

The legwires of the semiconductor bridge electric detonators typified by detonator 26a are then connected as illustrated in FIG. 1 so as to wire each semiconductor bridge electric detonator in series in electric trunkline circuit 20. When geophones and/or other suitable recording equipment is in place and all is in readiness for the shot, electric trunkline circuit 20 is connected to fireset 22 and the latter is operated to substantially simultaneously detonate each of the semiconductor bridge electric detonators typified by illustrated detonator 26a. As explained below, the utilization of semiconductor bridge electric detonators greatly reduces the scatter time in firing of the detonators and the low power requirement of the semiconductor bridge detonators enables firing an extremely large number of boreholes simultaneously without adversely affecting the reduced scatter attained by utilization of the semiconductor bridge electric detonators.

With each of the detonators firing substantially simultaneously, each of the lengths of low-energy detonating cord 28*a*, 28*b*, 28*c* and 28*d* are initiated at substantially the same time. Each of the lengths of low-energy detonating cord are of substantially the same length so that the burn time for each of them is substantially identical. As described below, the scatter introduced by very slight variations in burn time from length of cord to length of cord are quite small and, consequently, each of the booster charges 30*a*, 30*b*, 30*c* and 30*d* is initiated substantially simultaneously. As used herein and in the claims, the terms "substantially simultaneously" or the like, with reference to initiation of the booster charges and/or semiconductor bridge electric detonators, should be interpreted to acknowledge the inevitable degree of scatter in a multi-booster charge shot. As described herein, that degree of scatter is greatly reduced by the system of the present invention as compared to the prior art systems.

When the SCB detonator is fired, it requires about 8.1 microseconds to function, i.e., 0.0081 milliseconds ("ms"), with a standard deviation of less than 0.002 ms. The low-energy detonating cord detonates at the rate of approximately 6800 meters/sec. along its, e.g., approximately 3 meter (10 foot) length to initiate each booster. The detonation velocity of the low-energy detonating cord is very reproducible with an expected standard deviation of 0.0025 ms for the approximately 3 meter (10 foot) length.

In order to establish the standard deviation in function time of known seismic electric detonators and SCB electric detonators, the following three experiments were conducted.

Experiment 1

Ten standard, commercially available seismic electric detonators of one manufacturer were connected in series and fired using a 30 μF capacitor charged to 400 volts. These commercial detonators contain conventional electric hotwire igniters. The function time of each detonator in the series was measured and recorded. Function time is defined as the time lag between discharge of the capacitor of the fireset and detection of the explosive output from the detonator, as detected using an ionization switch or similar fast-response detector. The function times of the ten detonators ranged from 0.313 ms to 0.389 ms. The calculated mean function time was 0.356 ms and the calculated standard deviation was 0.028 ms.

Experiment 2

A second experiment was performed using ten standard commercially available electric seismic detonators produced by a second manufacturer. These commercial detonators also contained conventional electric hotwire igniters. Again, the detonators were electrically connected in series and fired using a 30 μF capacitor charged to 400 volts. The function time of each detonator in the series was measured and recorded. The function times of the ten detonators ranged from 0.824 ms to 1.500 ms. The calculated mean function time was 1.158 ms and the calculated standard deviation was 0.227 ms.

Experiment 3

A third experiment was performed in which ten semiconductor bridge (SCB) detonators were assembled and tested in series. The SCB detonators utilized in this set of experiments contained, instead of conventional electric hotwire initiators, an initiator comprising a semiconductor bridge (SCB) as described in Bickes, U.S. Pat. No. 4,708,060, the disclosure of which is incorporated by reference herein. The actual bridge dimensions of the SCB used in the detonators were as follows: 90 microns in length, 270 microns in width, and 2 microns in thickness. These dimensions were selected in order to give a good balance between the all-fire and no-fire levels of the detonator. The all-fire level is defined as the amount of energy delivered to the detonator from a capacitive discharge blast initiation system, or fireset, which will reliably function the detonator. The no-fire level is defined as the maximum level of constant (DC) current which will not function the detonator when applied continuously for a period of five minutes. As is commonly understood in the art, the all-fire level primarily relates to the reliability attribute of the detonator and the no-fire level primarily relates to its safety attribute. The 90 micron long by 270 micron wide by 2 micron thick SCB has an all-fire level of approximately 2 millijoules and a no-fire level of approximately 1 ampere. The particular bridge dimensions of the SCB and, therefore, the specific all-fire and no-fire levels of the detonators used in these experiments are typical, but not critical, and the present invention is not limited to the use of SCB detonators having the above-described characteristics.

The SCB's used in the SCB detonators were connected electrically to wires 58 and 59, as illustrated in FIG. 3A by means of two aluminum bond wires. One end of each bond wire was ultrasonically bonded to one of the two aluminum lands on the SCB igniter and the other end of each bond wire was ultrasonically bonded to wire 58 or 59. Wires 58 and 59, in turn, were electrically connected to legwires 52*a* and 54*a*, as shown in FIG. 3A.

Lead azide, a primary explosive, was utilized as the initiation charge (item 46 in FIG. 3A) in the SCB detonators tested in these experiments and PETN, a secondary explosive, was used as the output, or base, charge (item 44 in FIG. 3A). The SCB igniter, lead azide, and PETN were contained in an aluminum shell, unnumbered on FIG. 3A of the detonator (26*a* in FIG. 3A). The lead azide initiation charge was located in proximity to the SCB igniter such that the lead azide would be initiated when the SCB functioned and, as is well known in the art, the output from a lead azide charge will initiate a PETN charge in contact with the lead azide.

The ten SCB detonators were electrically connected in series and fired using a 30 μF capacitor charged to 400 volts. The function time of each SCB detonator in the series was measured and recorded. The function times of the ten SCB detonators ranged from 0.0067 ms to 0.0116 ms. The calculated mean function time was 0.0081 ms and the calculated standard deviation was 0.0017 ms.

Table I below compares the function times measured in the three experiments to compare a system in accordance with one embodiment of the present invention to two prior art systems. In Table I, the system in accordance with an embodiment of the invention is referred to as the "LEDC System", Experiment ("Exp.") 3. The two prior art systems are referred to in Table I as the "Seismic Cap System", Exp. 1 and Exp. 2. These prior art systems used conventional electric detonators in the booster charges, with the detonator legwires extending from the booster charges to the surface.

TABLE I

FUNCTION TIME OF CORD VS SEISMIC CAP SHOT FOR A BOREHOLE PATTERN HAVING 10-FEET (ABOUT 3 METERS) DEEP BOREHOLES

| | LEDC System | Seismic Cap Systems | |
|---|---|---|---|
| | Exp. 3 | Exp. 1 | Exp. 2 |
| Average Cord Time (ms) | 0.448 | NA | NA |
| Cord SD (ms) | 0.0025 | NA | NA |
| Average Cap Time (ms) | 0.0081 | 0.356 | 1.158 |
| Cap SD (ms) | 0.0017 | 0.028 | 0.227 |

"Average Cord Time" is the average time in milliseconds ("ms") the detonation of the low-energy detonating cord takes to travel along the 3.05 meter (10 feet) length of low-energy detonating cord.

"Cord SD" is the standard deviation ("SD") calculated for the observed detonations of the lengths of low-energy detonating cord.

"Average Cap Time" is the average time it takes the detonator to be initiated after it is energized, i.e., the average function time for the detonators tested.

"Cap SD" is the standard deviation calculated for the observed function times of the detonators, in ms.

It is seen from the data of Table I relating to Experiment 3, the test of the LEDC System in accordance with our embodiment of the present invention, that the total function time between the application of the firing pulse to the SCB until the detonation of the booster charge, can be calculated as follows.

$$\text{Average Cord Time}\pm 2\times(\text{Cord SD})+\text{Average Cap Time}\pm 2\times(\text{Cap SD})=0.448\pm 2\times(0.0025)+0.0081\pm 2\times(0.0017)=0.465-0.448=0.017\ \text{ms} \quad (1)$$

The function time is the difference between the maximum time of 0.465 ms and the minimum time of 0.448 ms, which is a range of 0.465–0.448=0.017 ms.

From the data of Table I relating to Experiments 1 and 2, the tests of two versions of the prior art Seismic Cap System, the range in functioning time for the standard seismic cap may be calculated by applying equation (1) above, with the Cord Time eliminated, i.e., set at zero, because low-energy detonating cord is replaced in these prior art systems by the legwires of the conventional down-hole electric detonators. The following results are obtained for Experiments 1 and 2.

Experiment 1:

$$0.356\pm 2\times(0.028)=0.412-0.300=0.112\ \text{ms}$$

Experiment 2:

$$1.158\pm 2\times(0.227)=1.612-0.704=0.908\ \text{ms}$$

The improvement of precision, i.e., reduction of scatter, of the system of the present invention as compared to that of the prior art seismic cap systems is calculated by dividing the range of the function time of the prior art systems by that of the system of the present invention. For Experiment 1, the result is 0.112/0.017=6.6 and the corresponding improvement in precision as compared to the prior art seismic cap system of Experiment 2 is 0.908/0.017=53.4. It is seen that the system of the invention provides in one case 6.6 times, and in the other case 53.4 times, better precision of timing of the explosion than does the system using the prior art seismic electric caps.

Other advantages of the present invention are that by replacing long lengths of electric legwires with the lengths of low-energy detonating cord 28*a*–28*d*, susceptibility of the system to the induction of stray electrical currents, which might cause premature initiation, is greatly reduced. In addition, the low-energy detonating cord is expended in use and does not leave behind, as do electric legwires, a carcass which can entangle construction equipment if construction is later carried out at the blasting site. Further, the absence of detonators in the booster charges eliminates sensitive primary explosives from the downhole, which, with the system of the present invention, includes only secondary explosives, which are much less susceptible to accidental initiation than primary explosives. Safety of the crews who load the boreholes is also enhanced because of the elimination of more sensitive primary explosive and long electrical conductor wires from the downhole portion of the system, the long wires being susceptible to the induction therein of stray currents from various sources.

A typical electric seismic blasting cap fires in about 0.356 to 1.158 ms but the variation in time-to-fire can be as much as about 0.908 ms when a 400 volt firing pulse is applied. It must be noted that as the applied firing energy is reduced, the time to fire increases.

The results shown in Table I and the calculations following Table I show that the range in functioning time of prior art seismic caps may be as great as 0.908 ms.

It can also be demonstrated that the timing benefits of using an SCB or performance-equivalent detonator are key to the overall system timing of the explosive initiation system described herein. For example, if one were to substitute standard electric caps for the SCB detonators in Experiment 3, using the data from Table I, the total function time would be calculated as follows.

Experiment 1

$$0.448\pm 2\times(\text{Cord SD})+(\text{Average Cap Time})\pm 2\times(\text{Cap SD})=0.743\ \text{to}\ 0.865\ \text{ms}$$

Function time range=0.865–0.743=0.122 ms

Experiment 2

The same calculation for Experiment 2 yields a function time range of from 1.147 to 2.065 ms.

Therefore, function time range=2.065–1.147=0.918 ms

The following calculations show that the relative precision when the SCB detonator is used in the systems of Experiments 1 and 2 is in one case 7.2 times, and in the other case 54.0 times, better than the prior art systems tested.

(0.122/0.017=7.2 and 0.918/0.017=54.0, respectively, for the standard seismic caps as tested in Experiments 1 and 2.

One factor inherent to the seismic blasting method is that it is assumed that when the firing signal is applied to the seismic electric cap it will always take the same time to shoot; however, this is not always the case as seen from Table I. This error translates to miscalculation of the positioning of the strata and underground formations. Obviously, such miscalculations can have significant adverse economic consequences, and require additional seismic survey work.

When fired using a capacitive discharge type blast initiation system, the SCB detonator will fire at energy levels of less than 5 millijoules. Indeed, SCB detonators are known which fire at energy levels in the range of 1–2 millijoules. A standard electric seismic cap will not fire at comparable energy levels and will, in fact not fire at energy levels up to approximately 10 millijoules.

Although the SCB detonator will fire at relatively lower energy levels (as compared to a standard electric seismic cap) when fired using a capacitive discharge blast initiation system, the SCB detonator will withstand greater levels of induced current without firing than will a standard electric seismic cap. This feature is due to the high thermal dissipation capability (high thermal conductivity) of the silicon substrate of the SCB. The ability to withstand induced current levels is an important consideration since such electrical currents may be induced by radios or other comparable sources of electromagnetic energy. For example, the SCB detonator will withstand a DC current of 1 amp applied continuously for 5 minutes without functioning. A standard seismic cap, on the other hand, will function when exposed to DC currents as low as 0.25 to 0.50 amps applied continuously for 5 minutes.

When only one SCB cap is used in the shot, the variation, which is very small (based on the 0.0017 standard deviation of the SCB cap and 0.0025 ms standard deviation of the LEDC), does not significantly increase the timing variation for the individually-shot holes in the seismic survey. Since the firing time is very predictable, and the variation small, this factor can be reliably anticipated and the accuracy of the resulting seismic record improved. It will be seen from Table I that the system of the present invention, although requiring longer to function than the prior art seismic cap system, is shown to be up to 53.4 times more precise. Precision is also important when boreholes are shot individually because the data from adjacent borehole shots is typically "stacked", or combined, to improve the signal-to-noise ratio (quality) of the seismic data.

Should each borehole in an array of boreholes be initiated by an SCB cap without the LEDC, i.e., by simply substituting the SCB detonator for the seismic electric detonator, the variation in timing precision would be still smaller by virtue of eliminating the scatter attributed to the LEDC and the 0.0017 standard deviation of the SCB detonator would represent the standard deviation of the entire system. However, among the reasons for utilizing the LEDC are that it is stronger than the electric cap legwire and thus less likely to break or abrade during lowering of the booster charge into the borehole. If electric legwires are broken an open circuit will result and if they are abraded, a short circuit may result, causing a firing failure. Further, the system is rendered much less susceptible to the induction therein of stray currents by substituting low-energy detonating cord for electrically conductive downhole legwires, which may be up to about 30.5 meters (one hundred feet) or more in length.

It should be noted that the principal concern is the precision of the timing, not the average time to fire. If the system shoots with a predictable average time and with a small standard deviation, this can be factored into the seismic calculations and will not adversely affect the accuracy of the calculations as will increased scatter.

Figure 4:
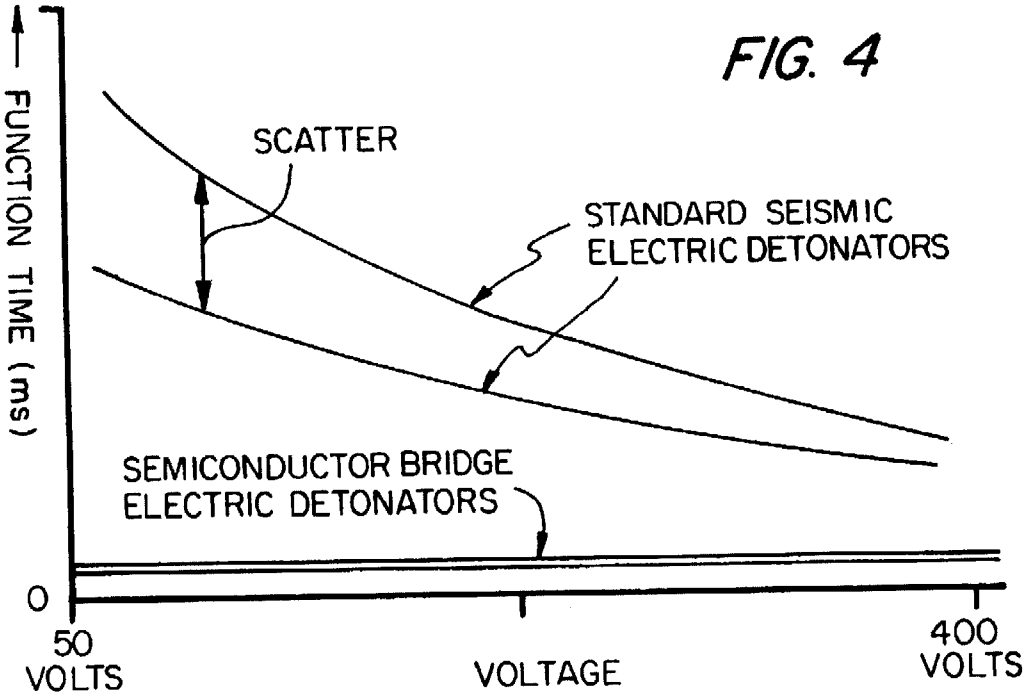
FIG. 4 is a plot of the function time versus firing voltage for standard and semiconductor bridge electric detonators.

FIG. 4 illustrates in a qualitative way the improvement in scatter time attained by the practices of the present invention. In a multi-borehole shot, such as illustrated in FIG. 1, if conventional non-SCB electric detonators were used in the booster charges 30*a*–30*d*, with their legwires substituting for the lengths of low-energy detonating cord 28*a*–28*d*, the scatter to be expected in the function time in which the booster charges 30*a*–30*d* were initiated would be as illustrated in FIG. 4, which shows an appreciable scatter time, especially at low firing voltages of 50 volts or so. However, over the entire range of firing voltage illustrated, from 50 to about 400 volts, it is seen that the scatter introduced by the semiconductor bridge electric detonating caps used in the system of the present invention, an embodiment of which is illustrated in FIG. 1, results in a much lower, more or less constant scatter.

While the invention has been described in detail with reference to particular embodiments thereof, numerous variations to the specific embodiments nonetheless lie within the scope of the appended claims.

What is claimed is:

1. A detonation system for initiating one or more booster charges respectively disposed in one or more boreholes formed through the surface of a firing site and each having respective borehole bottoms, the system comprising:

an electric trunkline circuit disposed on the surface of the firing site and comprising one or more electric detonators connected therein, the trunkline circuit being connectable to a fire set capable of generating an electric signal in the trunkline circuit to fire the one or more electric detonators, and;

one or more booster charges disposed within one or more boreholes with at least one booster charge per borehole, each of the one or more booster charges being connected in signal-transfer relationship to an associated one of one or more lengths of low-energy detonating cord which extend from their associated booster charges through their associated boreholes to the surface of the firing site to provide initiating portions of the lengths of low-energy detonating cord at the surface, the initiating portions being connected in signal transfer relationship to their associated electric detonators, whereby initiation of the one or more electric detonators by the electric trunkline circuit initiates the lengths of low-energy detonating cord connected thereto, which in turn initiate the booster charges connected to the associated lengths of low-energy detonating cord.

2. The detonation system of claim 1 comprising a plurality of the booster charges disposed in respective ones of a plurality of the one or more boreholes.

3. The detonation system of claim 1 or claim 2 wherein the trunkline circuit further comprises one or more connector blocks having an associated one of the electric detonators disposed thereon and further having thereon retention means for securing the initiation portions of the associated lengths of low-energy detonating cord in signal transfer proximity to their associated electric detonators.

4. The system of claim 2 wherein the lengths of low-energy detonating cord are of substantially the same length.

5. The system of claim 1 or claim 2 wherein the electrically-initiated detonators comprise semiconductor bridge-initiated detonators.

6. The system of claim 1 or claim 2 wherein the electric detonators are characterized by being capable of being initiated by as little as 5 millijoules of energy and by having a variation in time to initiation after energization of not more than about ±5 microseconds.

7. The system of claim 1 or claim 2 wherein the lengths of low-energy detonating cord are connected to their associated booster charges without a detonator interposed between the low-energy detonating cord and the booster charge, whereby the booster charge is directly initiated by the length of low-energy detonating cord.

8. The system of claim 7 wherein the lengths of low-energy detonating cord have contact portions thereof retained within wells formed in the booster charges.

9. The system of claim 7 wherein the lengths of detonating cord have contact portions thereof embedded within the booster charges.

10. The system of claim 7 wherein the booster charge has a top surface and comprises a shell having a cup portion which extends above the top surface, a closure cap dimensioned and configured to be seated on the cup portion and having a plunger arm extending therefrom into the explosive charge when the closure cap is seated on the cup portion, the top surface having therein a cord well which is dimensioned and configured to snugly receive therein a doubled length of the low-energy detonating cord, and the plunger arm of the closure cap.

11. The system of claim 10 wherein the cup portion has a pair of apertures formed therein for passage of the length of low-energy detonating cord therethrough.

12. The system of claim 1 or claim 2 wherein the booster charges have top sections which are disposed facing the surface of the blasting site and base sections which are disposed facing their respective borehole bottoms, and are dimensioned and configured to direct more of their explosive energy in a downward direction than in an upward direction, and the initiating portions of the lengths of low-energy detonating cord are connected to the top sections of the booster charges.

13. The system of claim 12 wherein the top sections of the booster charges are of smaller diameter than the bottom sections of the booster charges.

14. The system of claim 13 wherein the top sections of the booster charges are of lesser mass than the bottom sections.

15. A seismic detonation system for substantially simultaneously initiating a plurality of booster charges respectively disposed in a plurality of boreholes formed through the surface of a firing site and having respective borehole bottoms, the system comprising:

an electric trunkline circuit disposed on the surface of the firing site and comprising a plurality of semiconductor bridge electric detonators connected therein, the trunkline circuit being connectable to a fire set capable of generating an electric signal in the trunkline circuit to fire the electric detonators; and a plurality of booster charges respectively disposed within a plurality of boreholes with at least one booster charge per borehole, the booster charges being respectively connected in signal-transfer relationship to contact portions of associated lengths of low-energy detonating cord, the lengths of low-energy detonating cord being substantially equal in length and extending from their associated booster charges through their associated boreholes to the surface of the firing site, the lengths of low-energy detonating cord being connected at the surface in signal transfer relationship to their associated electric detonators, whereby initiation of the electrically-initiated detonators by the electric trunkline circuit initiates the lengths of low-energy detonating cord which in turn initiate the booster charges.

16. The system of claim 15 wherein the lengths of low-energy detonating cord are connected to their associated booster charges without a detonator interposed between the low-energy detonating cord and the booster charge, whereby the booster charge is directly initiated by the length of low-energy detonating cord.

17. The system of claim 15 or claim 16 wherein the booster charges have top sections which are disposed facing the surface of the blasting site and base sections which are disposed facing the bottoms of their associated boreholes, the booster charges are dimensioned and configured to direct more of their explosive energy in a downward than in an upward direction, and the lengths of low-energy detonating cord are connected to the top sections of their associated booster charges.

18. The system of claim 17 wherein the top sections of the booster charges are of smaller diameter than the bottom sections of the booster charges.

19. The system of claim 18 wherein the top sections of the booster charges are of lesser mass than the bottom sections.

20. The system of claim 17 wherein the electric trunkline further comprises a plurality of connector blocks having respective ones of the electric detonators disposed therein and further having thereon retention means for securing a surface portion of the lengths of low-energy detonating cord in signal transfer proximity to their associated semiconductor bridge electric detonators.

21. A method of initiating one or more booster charges disposed in respective one or more boreholes formed in a blasting site, the booster charges being connected to the surface of the blasting site by one or more lengths of low-energy detonating cord which have contact portions disposed in signal transfer contact with their booster charges and which terminate in one or more surface sections of the low-energy detonating cord, comprises the steps of connecting the surface sections in signal transfer proximity to one or more electric detonators forming part of an electric trunkline circuit, connecting the trunkline circuit to a fireset capable of energizing the trunkline circuit to initiate the one or more electric detonators; and discharging the firing set whereby to initiate the one or more electric detonators which in turn initiate the one or more lengths of low-energy detonating cord which in turn initiate their associated booster charges.

22. The method of claim 21 wherein the electric detonators are semiconductor bridge electric detonators.

23. The method of claim 21 wherein the electric detonators are characterized by being capable of being initiated by as little as 5 millijoules of energy and by having a variation in time to initiation after energization of not more than about ±5 microseconds.

24. The method of claim 21 whereon the lengths of low-energy detonating cord are substantially equal in length.

25. The method of claim 21, claim 22, claim 23 or claim 24, including substantially simultaneously initiating a plurality of up to about 10 booster charges with a time scatter of not more than about 0.017 milliseconds.

26. The method of claim 21, claim 22, claim 23 or claim 24 wherein the lengths of low-energy detonating cord are connected to their associated booster charges without a detonator interposed between the low-energy detonating cord and the booster charge, whereby the booster charge is directly initiated by the length of low energy detonating cord.

27. The method of claim 21, claim 22, claim 23 or claim 24 wherein the booster charges have top sections which are disposed facing the surface of the blasting site and base sections which are disposed facing the bottoms of their associated boreholes, and are dimensioned and configured to direct more of their explosive energy in a downward than in an upward direction, and the lengths of low-energy detonating cord are connected to the top sections of their associated booster charges.

* * * * *

UNITED STATES PATENT AND TRADEMARK OFFICE

CERTIFICATE OF CORRECTION

PATENT NO. : 5,714,712

DATED : February 3, 1998

INVENTOR(S) : David W. Ewick et al

It is certified that error appears in the above-indentified patent and that said Letters Patent is hereby corrected as shown below:

In column 1, line 10, replace "low energy" with --low-energy--;

line 28, replace "high energy" with --high-energy--;

line 36, replace "high energy" with --high-energy--;

line 37 to line 38, replace "high energy" with --high-energy--;

line 64, after "data" replace "is" with --are--.

In column 3, line 41, replace "fireset" with --fire set--;

line 43, replace "firing" with --fire--.

line 54, replace "0.017 milliseconds" with --0.0017 milliseconds--;

In column 5, line 3, replace "singly-reflected" with --single-reflected--;

line 5, replace "phenomena" with --phenomenon--;

Line 61, replace the indicator numeral "28" with --28a--.

In column 6, line 51, replace "portion" with --section--.

In column 7, line 33, replace "41 a" with --41a--;

line 50, replace "member" with --cap--;

line 51, replace "41 a" with --41a-- and replace "ribs" with --shoulders--.

UNITED STATES PATENT AND TRADEMARK OFFICE

CERTIFICATE OF CORRECTION

PATENT NO. : 5,714,712

DATED : February 3, 1998

INVENTOR(S) : David W. Ewick et al

It is certified that error appears in the above-indentified patent and that said Letters Patent is hereby corrected as shown below:

In column 14, line 10 of claim 1, replace "detonators, and;" with --detonators; and--;

line 1 of claim 9, between "lengths of" and "detonating" insert --low-energy--.

In column 16, line 8 of claim 21, replace "steps of" with --steps of:--;

line 11 of claim 21, replace "circuit," with --circuit;--;

line 1 of claim 24, replace "whereon" with --wherein--;

line 3 of claim 25, after "time scatter" insert --standard deviation--;

line 4 of claim 25, change "0.017 milliseconds" to read --0.0017 milliseconds--;

line 6 of claim 26, replace "low energy" with --low-energy--.

Signed and Sealed this

Fifth Day of October, 1999

*Attest:*

*Attesting Officer*

Q. TODD DICKINSON

*Acting Commissioner of Patents and Trademarks*